United States Patent [19]

Lee

[11] Patent Number: 4,979,421

[45] Date of Patent: Dec. 25, 1990

[54] C# KEY ROLLER FOR FOOT TUBE OF FLUTE

[75] Inventor: Hyo I. Lee, Seoul, Rep. of Korea

[73] Assignee: Samick Musical Instruments Mfg. Co., Ltd., Inchon, Rep. of Korea

[21] Appl. No.: 367,470

[22] Filed: Jun. 16, 1989

[30] Foreign Application Priority Data

Feb. 16, 1989 [KR] Rep. of Korea ..... 1626/1989

[51] Int. Cl.[5] ..... G10D 7/02

[52] U.S. Cl. ..... 84/384

[58] Field of Search ..... 84/380 R, 380 A, 380 B, 84/380 C, 381, 382, 383 R, 383 A, 383 B, 384, 385 R, 385 A, 385 B, 385 P

[56] References Cited

FOREIGN PATENT DOCUMENTS 326145 5/1903 France ..... 84/384

701046 3/1931 France ..... 84/384

2606541 5/1988 France ..... 84/384

*Primary Examiner*—Brian W. Brown

*Attorney, Agent, or Firm*—Price, Heneveld, Cooper, DeWitt & Litton

[57] ABSTRACT

A C# key roller for the foot tube of a flute is disclosed which is constructed such that a connector shaft hole within the connector is made in the form of a through hole by additionally providing an extended threaded through portion, and the opposite ends of the said through hole are fitted with an auxiliary bolt and with the leading end of the roller shaft, thus forming a double lock system. With this arrangement, the setting of the gap between the roller and connector during assembly is made easy, the loosening of the thread portions is prevented, and resetting is made possible upon the wearing-out of the sliding portion of the roller and the roller shaft.

1 Claim, 4 Drawing Sheets

"B"

C# KEY ROLLER FOR FOOT TUBE OF FLUTE

FIELD OF THE INVENTION

The present invention relates to a key roller for various wind music instruments, and particularly to a C# key roller for the foot tube of flute as an examplary embodiment.

BACKGROUND OF THE INVENTION

The key roller of the conventional instrument is constituted as shown in FIG. 8, and therefore, there exist the following difficulties. That is, the determination of the gap between a roller 5' and a roller connector 7' is difficult when assembling. Further, during the use of the instrument, the sliding portion for the roller 5' and a roller shaft 10' wear out, thereby forming a gap between the roller 5' and the roller connector 7' making. Further, during musical performances, the thread portion 11' becomes loosens, and therefore, the roller shaft 10' and the roller connector 7' are liable to become detached from each other. Further, once the roller is worn out, re-adjustment is impossible, thereby requiring replacement of the roller itself, which is an uneconomical feature of the conventional roller.

SUMMARY OF THE INVENTION

Therefore it is an object of the present invention to provide a C# key roller for the foot tube of the flute in which all of the above mentioned disadvantges of the conventional device are overcome.

In achieving the above objective, the device of the present invention is constituted such that the connector shaft hole is made in the form of a through hole, and the end of the hole opposite from the front side where the leading end of the roller shaft is connected is closed with a bolt, thereby providing a double lock system. With this arrangement, setting during the assembly is made easy, loosening of the thread portion is prevented, adjustment of the gap between the roller and the roller connector is facilitated, and resetting is made possible upon the wearing of the sliding portion of the roller and the roller shaft.

BRIEF DESCRIPTION OF THE DRAWINGS

The above object and advantages of the present invention will become more apparent from the description of the preferred embodiment of the present invention with reference to the attached drawings in which.

DESCRIPTION OF THE PREFERRED EMBODIMENT

Figure 1:
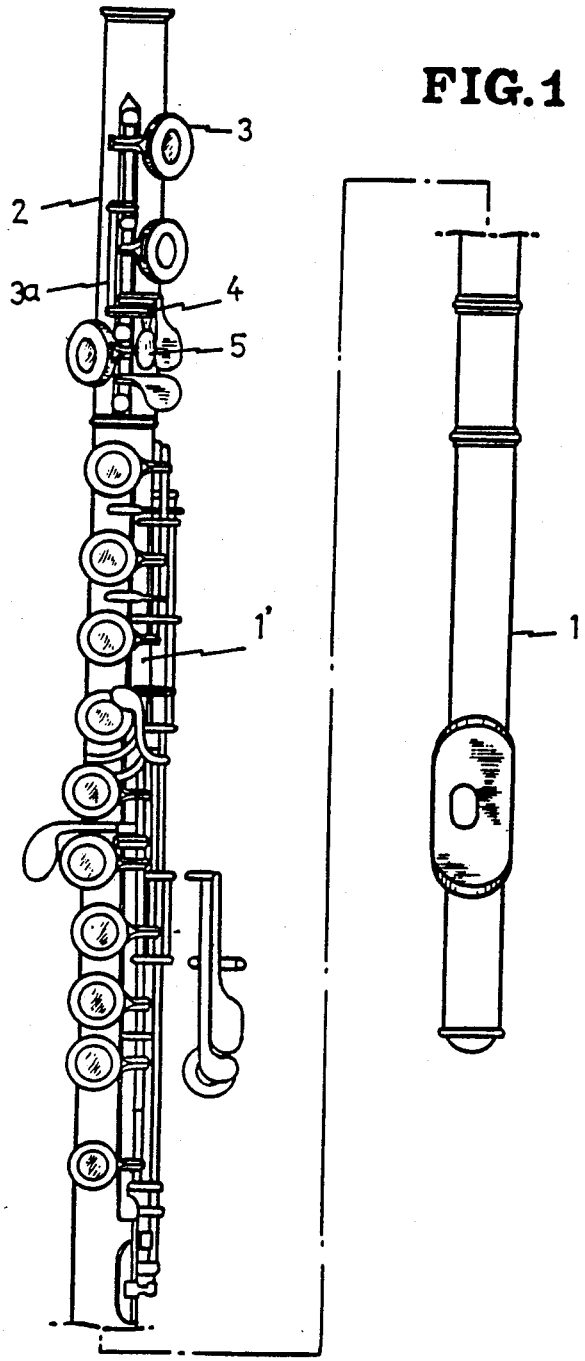
FIG. 1 is a frontal view of the flute to which the device of the present invention is installed.
Figure 3:
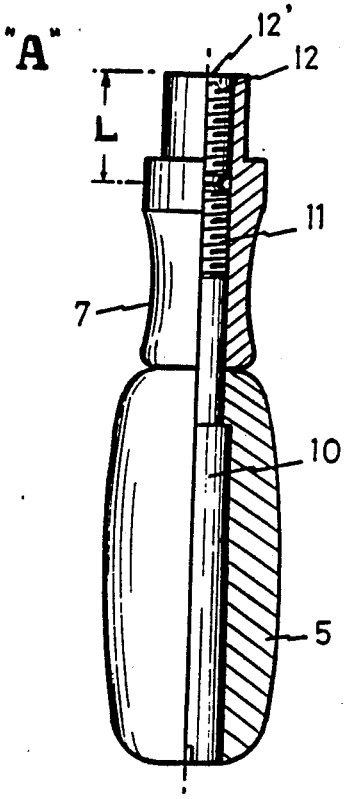
FIG. 3A is an enlarged partially sectional view of the key roller according to the present invention.
FIG. 3B is a plan view of the rear face of the auxiliary bolt, in which hexagonal slot is formed.

The characteristic features of the device according to the present invention are such that a pad cap 3 for a C# sound installed on foot tube 2 of a flute 1 is connected to rod 3*a* and a C# key lever 4. Roller 5 is connected to the key lever 4 through a connector 7 which is secured to the said key lever 4. The lever 4 is connected to the roller by securing the thread hole 9 of the connector 7 to a leading thread portion 11 of a shaft 1C as in the conventional construction.

The unique feature of the device of the present invention is that a through threaded portion L is provided at the leading end of a connection shaft hole 8 of the connector 7 and the leading thread portion 11 of the roller shaft 10 is fitted into the threaded hole 9 of the connector 7, while an auxiliary bolt 12 is threadably inserted into the opposite end of the threaded hole 9, that is, in to the through thread portion L, thereby securing it to the connector 7.

Figure 2:
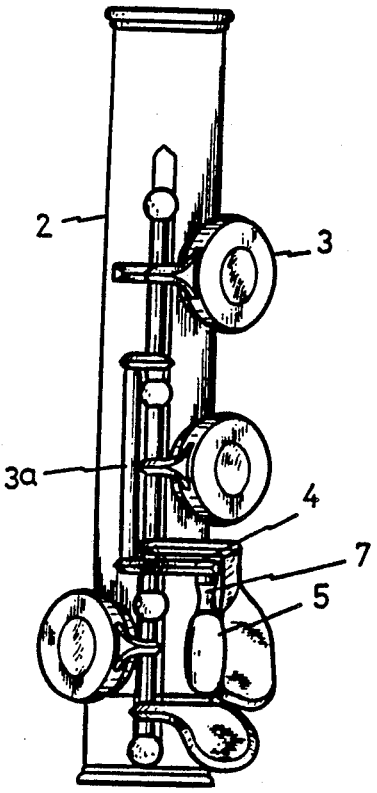
FIG. 2 is an enlarged frontal view of the foot tube to which the device of the present invention is installed.
Figure 3:
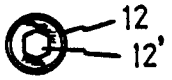
Figure 4:
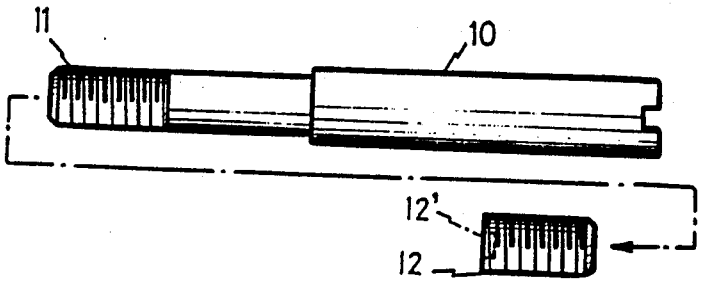
FIG. 4 is an enlarged view of the key roller shaft and the auxiliary bolt.
Figure 5:
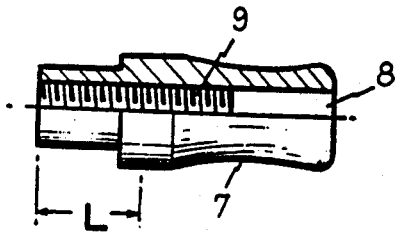
FIG. 5 is an enlarged partially sectional view of the key roller connector according to the present invention.
Figure 6:
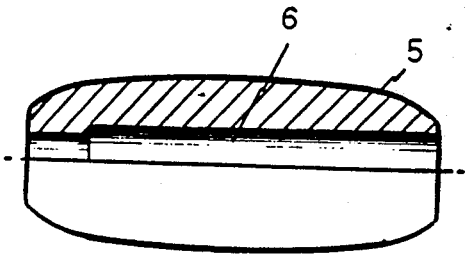
FIG. 6 is an enlarged partially sectional view half of the key roller according to the present invention.
Figure 7:
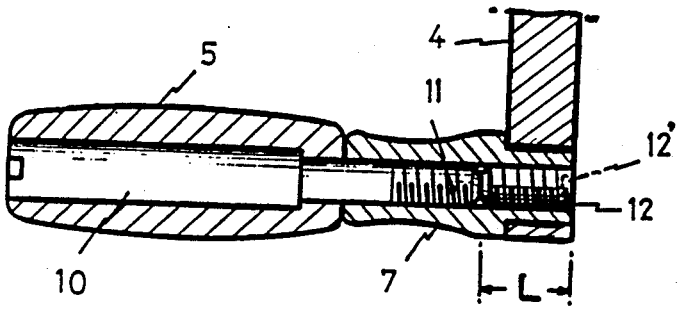
FIG. 7 is a sectional view showing the assembled condition of the device according to the present invention.
Figure 8:
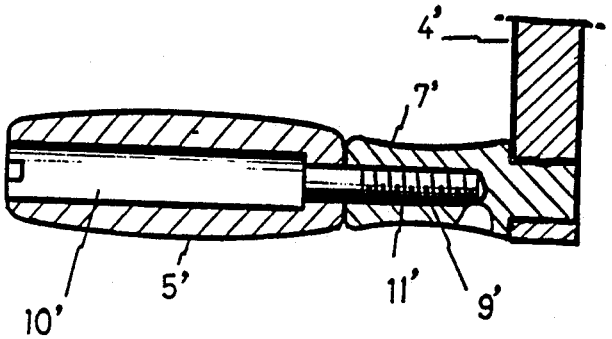
FIG. 8 is a sectional view showing the assembled condition of the conventional key roller.

The function and effect of the device according to the present invention will be described below. If the device of the present invention is used as illustrated in FIGS. 1 and 2, it indicates its use in an ordinary flute. When the player manipulates the C# pad cap 3 for the foot tube, that is, when the pad cap 3 of the foot tube is closed or opened, the player plays the instrument by pressing the roller 5. The leading thread hole 9 of the connection shaft hole 8 is extended to form the through thread portion L, and the leading thread portion 11 of the roller shaft 10 and the auxiliary bolt 12 are respectively threadably fitted into the opposite ends of the connection shaft hole 8, thereby forming a set.

Therefore, the assembly of the device according to the present invention is very easy. The assembly process is such that the connector 7 is secured to the key lever 4 with the opposite end of the hole formed within the connector 7. The hole consists of threading for the shaft connection hole 8 being extended through the portion L. Thus, the leading thread portion 11 of the roller shaft 10 can be made to press against the auxiliary bolt 12, thereby forming a double lock system. Accordingly the loosening of the threads is prevented, and adjustment of the gap between the roller 5 and the roller connector 7 is made easy. Thus, resetting can be made easily by simple work upon the occurrence of wear of the sliding portion between the roller 5 and the roller shaft 10, and the auxiliary bolt 12 having a hexagonal slot 12', on the rear face thereof is easy to loosen or tighten.

Thus, the device according to the present invention overcomes all the disadvantages of the conventional device such as the setting the difficulty of gap between the roller and the connector when the sliding portion between the roller and the roller shaft wears out becomes loosened during use. Without this invention, the coupling of the threads between the roller shaft and the connector can become released during use and a re-adjustment of the worn out roller is impossible, thereby requiring the replacement of the worn out roller.

What is claimed is:

1. Means for mounting a C# key roller for a foot tube of a flute having a C# orifice, a cap for the C# orifice and a lever connected to said cap for manipulating said cap, said lever having an actuator roller mounted thereon, a rod-like support element extending through and projecting beyond one end of said roller, a spacer having a central opening extending therethrough, said spacer being secured to said lever, said central opening of said spacer having a threaded portion, said threaded portion of said central opening extending to an end of said spacer remote from said roller, a threaded locking member mounted in an end of said central opening opposite roller and tightly seated against an adjacent end of said rod to lock said rod against rotation with respect to said spacer when said cap is manipulated by said lever.

* * * * *

UNITED STATES PATENT AND TRADEMARK OFFICE

CERTIFICATE OF CORRECTION

PATENT NO. : 4,979,421

DATED : December 25, 1990

INVENTOR(S) : Hyo I. Lee

It is certified that error appears in the above-identified patent and that said Letters Patent is hereby corrected as shown below:

Column 1, line 19:
After "making" insert -- them loose --.
Column 1, line 21:
After "11'" delete -- becomes --.
Column 2, line 8:
After "on" insert -- a --.
Column 2, line 13:
"shaft 1C" should be -- shaft 10 --.
Column 2, line 41:
Before "threading" insert -- the --.
Column 2, line 55:
"setting the difficulty of" should be -- difficulty of setting the --.
Column 2, line 57:
After "out" insert -- and --.
Column 4, line 2:
After "opposite" insert -- said --.

Signed and Sealed this

Twenty-third Day of June, 1992

*Attest:*

DOUGLAS B. COMER

*Attesting Officer*

*Acting Commissioner of Patents and Trademarks*